United States Patent [19]

Fischer et al.

[11] 4,193,742

[45] Mar. 18, 1980

[54] VACUUM PUMP ASSEMBLY WITH BUILT-IN SHUTOFF VALVE

[75] Inventors: Klaus Fischer, Wetzlar; Helmut Flauger, Braunfels; Kurt Balzer; Roland Fischer, both of Wetzlar, all of Fed. Rep. of Germany

[73] Assignee: Arthur Pfeiffer Vakuumtechnik Wetzlar GmbH, Asslar, Fed. Rep. of Germany

[21] Appl. No.: 883,792

[22] Filed: Mar. 6, 1978

Related U.S. Application Data

[63] Continuation-in-part of Ser. No. 625,717, Oct. 24, 1975, abandoned.

[30] Foreign Application Priority Data

Oct. 31, 1974 [DE] Fed. Rep. of Germany ..... 2451685

[51] Int. Cl.[2] ..... F04B 49/06

[52] U.S. Cl. ..... 417/295; 417/24

[58] Field of Search ..... 417/24, 295, 293, 306

[56] References Cited

U.S. PATENT DOCUMENTS

| | | | |
|---|---|---|---|
| 1,055,139 | 3/1913 | Conrades | 417/295 |
| 1,104,019 | 7/1914 | Thomas | 417/306 |
| 1,701,359 | 2/1929 | Case | 417/293 |
| 1,786,128 | 12/1930 | Sanford | 417/295 |
| 1,948,907 | 2/1934 | Egli | 417/295 |
| 1,988,296 | 1/1935 | Blume et al. | 417/293 |
| 2,566,623 | 6/1951 | Lipman | 417/295 |
| 3,031,128 | 4/1962 | Rubbra | 417/293 |
| 3,611,715 | 10/1971 | Tatsutoni et al. | 417/293 |

FOREIGN PATENT DOCUMENTS

| | | | |
|---|---|---|---|
| 283484 | 7/1921 | Fed. Rep. of Germany | 417/42 |
| 521241 | 3/1921 | France | 417/42 |

*Primary Examiner*—William L. Freeh

*Attorney, Agent, or Firm*—Toren, McGeady and Stanger

[57] ABSTRACT

A vacuum pump assembly is provided which includes a built-in pneumatic valve for closing the suction port of a vacuum pump of the assembly with an auxiliary valve being provided for controlling operation of the pneumatic valve. An electromagnetic valve is utilized as the auxiliary valve and a generator coupled with the shaft of the vacuum pump generates electric current in accordance with the operating stages of the pump in order to control the auxiliary valve.

6 Claims, 2 Drawing Figures

VACUUM PUMP ASSEMBLY WITH BUILT-IN SHUTOFF VALVE

This application is a Continuation-In-Part of prior application Ser. No. 625,717 filed Oct. 24, 1975, now abandoned.

BACKGROUND OF THE INVENTION

The present invention relates generally to vacuum pump assemblies and, more particularly, to a rotary vacuum pump having a pneumatic valve which is installed in its suction port and which is controlled by an auxiliary valve. The pneumatic valve closes the suction port of the vacuum pump in a vacuum-tight manner against an adjoining container when the vacuum pump is stationary.

Vacuum pumps of the type to which the present invention relates generally require a shutoff valve located between the working chamber of the vacuum pump and the container to be evacuated by the pump with the shutoff valve closing off in a vacuum-tight manner the flowpath between the container to be evacuated and the working chamber of the pump when the pump is stationary. Without the provision of such a shutoff valve, the container can be ventilated through the pump and, additionally, sealing fluid may be introduced into the container particularly in liquid sealed vacuum pumps.

Vacuum pumps having a pneumatic valve which is controlled by an auxiliary valve in order to close off the suction port of the pump are known in the art. In such prior art devices, the auxiliary valve is usually actuated mechanically by a centrifugal switch which is coupled with the pump shaft.

However, such pump or valve controls have the disadvantage that the pneumatic valve may allow atmospheric air to be introduced therein. The atmospheric air may intrude into the container, and this is most likely to occur particularly when the pump is restarted after having been stopped. It is very important that such an occurrence be avoided particularly in cases where the pump is to be utilized in handling toxic or expensive gases.

A further disadvantage of such pumps is the susceptibility of the centrifugal switch to malfunction or improper operation.

Auxiliary valves which operate to actuate the shutoff valve, for example, by hydraulic means, have the disadvantage that their operation may be impeded or stopped when the hydraulic fluid, normally the sealing oil contained in the pump, is mixed or loaded with gas. Problems may also arise due to a high level of temperature dependence with regard to the viscosity of the hydraulic fluid.

It is an object of the present invention to provide a vacuum pump wherein the suction port may be rapidly sealed in a vacuum-tight manner at a rotational speed below the minimum speed of the pump by means of a pneumatic valve which is controlled by an auxiliary valve. The present invention particularly aims toward providing such a device whereby the control of the auxiliary valve is independent of the power lines of the pump and is effected without additional mechanical or hydraulic switches or final control elements.

SUMMARY OF THE INVENTION

Briefly, the present invention may be described as a vacuum pump assembly which includes a vacuum pump having a suction port and a pump shaft, a built-in pneumatic valve for closing the vacuum port in a vacuum-tight manner and an auxiliary valve for controlling operation of the pneumatic valve. The particular improvement of the present invention involves the utilization of an electromagnetic valve as the auxiliary valve with the assembly being provided with generator means coupled with the pump shaft for generating an electric current in accordance with the operating stages of the vacuum pump in order to control the electromagnetic auxiliary valve.

Accordingly, with the present invention the electromagnetic auxiliary valve is closed in response to current which is generated by the generator coupled with the pump shaft. The generator may be dimensioned such that the auxiliary electromagnetic valve will actuate the pneumatic valve at 80% of the rated rotational speed of the pump.

One object of the invention is to provide a pump which may be ventilated after the suction port is in the closed condition, while opening of the suction port is delayed by the pneumatic valve when the pump is started again. The ventilation is desirable in liquid-sealed pumps so that the sealing liquid may be prevented from flowing into the valve interior space and from filling up the working chamber of the pump. Beyond this, starting of the pump is facilitated if it is not started under a vacuum or while filled with liquid.

The aforementioned object is accomplished by the present invention by providing a connection from the outlet of the auxiliary valve to the working space of the vacuum pump with such a connection being maintained at least with the pneumatic valve in the closed position.

A connection line of this type may be formed, for example, by providing a gap between the moving and the stationary parts of the pneumatic valve. In another embodiment, such a connecting line will only be cleared by the pneumatic valve itself when the pneumatic valve is in the closed condition. Such a design insures that the valve will close rapidly and the pump will be ventilated with delay and that the valve will open with delay when the pump is once again started, since the space within the operating chamber of the valve is slowly evacuated by the connecting line until the valve is opened by spring force.

A further problem sought to be solved by the present invention is the prevention of introduction of extraneous gas into the operating space of the pneumatic valve and, thus, also into the suction space of the vacuum pump. This problem is solved by the present invention by connecting the operating space of the valve through the auxiliary valve with the exhaust space of the vacuum pump.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
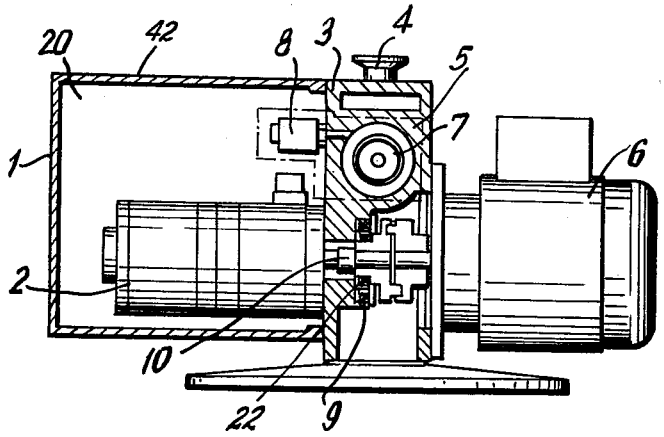
FIG. 1 is a sectional view showing an overall pump assembly utilizing the principles of the present invention.

An embodiment of a vacuum pump assembly in accordance with the present invention is depicted in FIG. 1 which shows by way of example a rotary vane pump. The pump includes a casing 1 having housed therein a pump body 2 with a stand 3 being provided upon which the body 2 and the casing 1 are connected by flanged means. The assembly also includes suction and exhaust ports 4, a valve member 5 and a driving motor 6.

It is to be understood that the present invention is generally independent of the operating principles of the vacuum pump utilized except that it is intended primarily for application in a rotary pump. Also, the invention is intended to apply particularly to liquid-sealed pumps such as rotary vane vacuum pumps.

Figure 2:
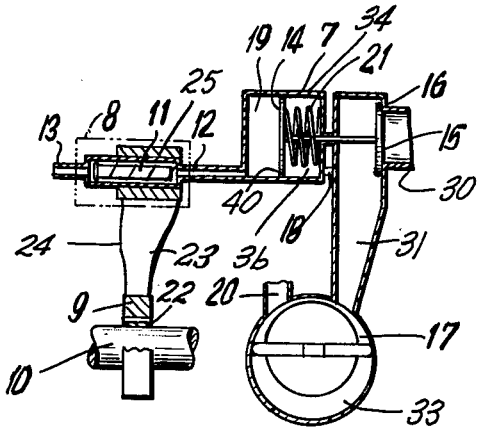
FIG. 2 is a schematic diagram illustrating in more detail the particular elements of the invention.

FIG. 2 depicts in more detail the principal design and operating features of the valve combination of the present invention. A vacuum pump 17 includes a working chamber 33 and a suction conduit 31 in flow communication with a conduit 30.

In the embodiment depicted, the conduit 30, which is in flow communication with a space or enclosed volume (not shown) which is to be evacuated, is opened and closed by operation of a pneumatic valve 7 including a valve body 15 which seats upon a valve seat 16 defined by the conduit 30. When the vacuum pump 17 is started with the valve body 15 unseated from the valve seat 16, the winding 25 of an auxiliary valve 8 is excited by a generator 32, which comprises a stator 9 and a rotor 22, the rotor 22 being coupled with a shaft 10 of the vacuum pump 17. As a result, a core 11 of the auxiliary valve 8 is actuated to close communication from a line or conduit 13, leading to an exhaust space 20 of the pump 17, and a line or conduit 12 extending between the auxiliary valve 8 and the pneumatic valve 7. As a result, gas at atmospheric pressure from the space 20 is prevented from entering the conduit 12.

The pneumatic valve 7 includes a cylindrical body 34 divided into a pair of chambers 19 and 36 by a piston 14 which is affixed with the valve body 15.

During the time that the winding 25 is excited by rotation of the shaft 10 to close the line 12, the valve body 15 remains unseated from the seat 16 by operation of a spring 21 and the conduit 30 remains open because there is no pressure difference between chamber 19, chamber 36, conduit 31 and conduit 30.

Considering this phase of operation in somewhat more detail, rotation of shaft 10 causes rotation of rotor 22, which consists of a number of permanent magnets placed in a annular arrangement around the shaft 10. The stator 9 of the generator consists of a coil which is fixed in the housing of the pump around the rotor 22. When the pump shaft 10 turns, a direct current is induced in the windings of a coil 9 and this current is transmitted to the coil 25 of the auxiliary valve 8. Wires 23 and 24 interconnect the coil 25 with the coil 9. Accordingly, when the shaft 10 rotates at a speed sufficient to energize coil 25, core 11 of the valve 8 will be magnetically driven leftwardly as viewed in FIG. 2 to close the conduit 13 and cut off gas flow therethrough to the line 12.

During this period of time, with the valve body 15 unseated from the seat 16 and with the conduit 30 open, operation of the pump 17 operates to evacuate chamber 33, conduit 31 and the space or volume in communication with the conduit 30.

When the space or volume in communication with the conduit 30 has been evacuated, rotation of the pump shaft 10 terminates with termination of operation of the pump 17. As a result, the generator 9 will not generate a voltage and the auxiliary valve 8 will be opened. This occurs as a result of atmospheric pressure acting against the core 11 of the auxiliary valve 8 in the opening direction, or rightwardly as viewed in FIG. 2. The gas or air now flowing through the lines 12 and 13 will exert a force against the valve body 15 through the piston 14 moving within the cylindrical body 34 of the valve 7 thereby driving the valve body 15 against the valve seat 16 and consequently sealing in a vacuum tight manner the volume to be evacuated, which may be a container or similar device (not shown).

When the pump is once again started, the auxiliary valve 8 will close in the manner previously described and the chamber 19 of the pneumatic valve 7 on the left side of the piston 14 will be evacuated. When the pressure on the left side of the piston 14 has dropped to a level sufficiently low to permit the spring pressure of a spring 21 of the pneumatic valve 7 to move the valve body 15 away from the valve seat 16, the pneumatic valve 7 will open thereby opening the conduit 30.

In the embodiment depicted in the drawings, the valve 7 is lifted from its seat by spring force. Of course, the valve may also be arranged in a suitable position whereby it may be opened by its own weight or by a combination of spring force and the force of gravity.

An important aspect of the present invention resides in the fact that a small annular gap 40 is maintained between the outer edge of the piston 14 and the inner wall or side of the cylindrical body 34 of the valve 7. Thus, a metered flow is provided between the chambers 19 and 36 from one side to the other of the piston 14.

As a result of the gap 40 between the piston 14 and the cylindrical body 34 of the valve 7, when the auxiliary valve 8 opens, gas of atmospheric pressure coming from line 13 flows through the line 12 into the chamber 19 within the valve 7 on the left of the piston 14. Provided that the whole system is under vacuum, the piston 14 will move to the right thus pressing the valve body 15 against the seat 16. Because of the flow resistance through the gap 40, this movement is terminated before the flow of gas through the gap creates a pressure rise in the chamber 36 and pressure equilibrium on both sides of the piston 14. However, after a slight delay, the chamber 36 and, through the bore 18 and conduit 31, the working space 33 of the pump 17, will be at atmospheric pressure. This pressure will be exerted on the valve body 15 of the pneumatic valve 7 thereby keeping the valve closed thereby maintaining the vacuum within the conduit 30 and within the evacuated volume in communication therewith.

When the pump is restarted, the auxiliary valve 8 closes by actuation of the winding 25. Chamber 36 will be evacuated through the bore 18. Evacuation of the chamber 19 through the gap 40 will occur after a period of delay, thus insuring that a good vacuum is created in the suction conduit 31 before the valve body 15 is lifted off the seat 16 by virtue of the spring force of the spring 21 overcoming the pressure within the space 19. Thus, backflow of gas into the chamber or volume to be evacuated is minimized.

As will be noted from the foregoing, one of the most important aspects of the present invention involves the fact that the auxiliary valve 8 is actuated by the generator 32 which is directly responsive to the drive shaft 10 of the vacuum pump 17 itself. Thus, the generator 32 actuating the auxiliary valve 8 is directly fixed upon the pump rotor shaft. This means that the position of the auxiliary valve 8 and the opening or closing of the valves by actuation of the winding 25 and movement of the core 11 depends exclusively and directly upon the rotation or non-rotation of the actual shaft 10 of the pump 17.

Thus, control of this valve is independent from external forces and is also independent from the function of the connection between the driving motor and the pump, e.g., couplings, V-belts or similar devices. It is of advantage in the present invention due to this design that the generator will not exhibit wear and that a more reliable device than electromechanical or electrohydraulic switches is provided.

A second very important feature of the invention is the annular gap 40 which is formed between the piston 14 and the body 34. This permits delayed metered flow to occur from one side of the piston 14 to the other.

In the operation of the device, when the pump commences to slow down or to approach a stop condition, the responsiveness of the generator 32 will cause the auxiliary valve 8 to open in response to spring pressure due to the elimination of the electromagnetic force maintaining the core 11 in the closed position. As a result, atmospheric gas from the space 20 of the pump will enter the line 13, flow through the line 12 and be applied to the left side of the piston 14 thereby overcoming the force of the spring 21 and closing the valve body 15. When this occurs, a vacuum condition will still exist within the working space of the pump. The atmospheric gas will only be present in the chamber 19. Thus, closure of the valve body 15 while a vacuum condition exists within the suction conduit 31 will prevent any unwanted leakage relative to the space being evacuated. Once the valve body 15 is closed, atmospheric gas may be permitted to enter the space within the pump working chamber 33. Therefore, atmospheric gas is permitted to pass with delay to the right side of the piston 14 into the chamber 36 through the gap 40 between the periphery of the piston 14 and the inner wall of the cylindrical body 34 and through the bore 18 into the working space of the pump 17. When this occurs, and when atmospheric pressure builds up within the conduit 31 and on the left of the valve body 15, the valve body 15 will remain seated thereby maintaining the vacuum container closed.

The gap 40 between the piston 14 and the cylinder 7 should be between about 0.12 and 0.07 mm. Of course, such dimensions will depend upon the overall size of the valve and of the pump which is utilized.

The pump may now be started again with greater ease since its inlet and outlet will be under the same, i.e., atmospheric, pressure.

When the pump is restarted, the auxiliary valve 8 will close by energization of the winding 25 and actuation of the core 11. The generator 32 which responds to rotation of shaft 10 to bring about this stage of operation, is so dimensioned that it will create sufficient power only if a minimum velocity of revolution of the pump shaft 10 has been achieved. When this occurs, the pump will draw a vacuum within the chamber 36 through the bore 18. With some delay, the chamber 19 on the left side of the piston 14 will also be evacuated through the gap 40. When a vacuum condition exists within the chamber 19, the spring 21 may operate to overcome the force of pressure previously applied against the psiton 14 thereby opening the valve body 15. This will not occur until a good vacuum is drawn within the system and particularly in the conduit 31 and as a result backflow of gas into the vacuum chamber is minimized.

The inlet 13 of the auxiliary valve 8 should be connected to the outlet of the vacuum pump if the introduction of extraneous gases is to be prevented. In a rotary vane pump, the actual pumping is performed in the pump body 2 which is immersed in an oil bath in the lower part of a casing 42. The upper part of this casing serves for the separation of the pumped gas from the oil and is connected to the outlet socket 4. This space is always under atmospheric pressure and filled with the pumped gas. It is therefore, an advantage—and one which is an important aspect of the invention—that the auxiliary valve is placed completely within the space 20 so that if it opens only gas which is exhausted from the pump body 2 may enter the valve through its inlet 13.

It should be noted that the working space 33 of the pump 17 is within the pump body 2, and that in cases where poisonous or expensive gases must be pumped, the outlet of the pump must be connected to special containers for recovery of the gases.

While spcific embodiments of the invention have been shown and described in detail to illustrate the application of the inventive principles, it will be understood that the invention may be embodied otherwise without departing from such principles.

What is claimed is:

1. A vacuum pump assembly comprising: a vacuum pump including a suction port adapted to be placed in flow communication with a space to be evacuated; valve means for opening and closing said suction port; spring means biasing said valve means toward a position to open said suction port; and control means for applying to said valve means a closure pressure acting against said spring means to cause said valve means to close said suction port when said vacuum pump is stopped and for removing said closure pressure therefrom when said vacuum pump is started in order to permit opening of said suction port; said control means including auxiliary valve means operating to open and close in response to starting and stopping of said vacuum pump to control application of said closure pressure to said valve means, cylinder means, piston means operatively engaged within said cylinder means, connecting means joining said piston means with said valve means for effecting correlative movement therebetween, means enclosing a pump working volume within which said valve means and suction port are located, and passage means placing said pump working volume in flow communication with said cylinder means; said auxiliary valve means being connected to effect application of said closure pressure to said piston means within said cylinder means against the force of said spring means; said passage means being sized to permit said closure pressure to flow from within said cylinder means into said pump working volume after said valve means have closed said suction port thereby to effect a delay in the application of said closure pressure within said pump working volume to avoid introduction of said closure pressure into said pump working volume while said suction port is open.

2. An assembly according to claim 1 wherein said vacuum pump includes a pump main shaft and wherein said control means include generator means coupled to said pump main shaft for controlling operation of said auxiliary valve means in response to operation of said pump.

3. An assembly according to claim 2 wherein said auxiliary valve means comprise an electromagnetically operated valve connected with said generator means.

4. A vacuum pump assembly comprising: a vacuum pump including a suction port adapted to be placed in flow communication with a space to be evacuated; valve means for opening and closing said suction port; spring means biasing said valve means toward a position to open said suction port; and control means for applying to said valve means a closure pressure acting against said spring means to cause said valve means to close said suction port when said vacuum port is stopped and for removing said closure pressure therefrom when said vacuum pump is started in order to permit opening of said suction port; said control means including auxiliary valve means operating to open and close in response to starting and stopping of said vacuum pump to control application of said closure pressure to said valve means, cylinder means, piston means operatively engaged within said cylinder means, connecting means joining said piston means with said valve means for effecting correlative movement therebetween, means enclosing a pump working volume within which said valve means and suction port are located, and passage means including means defining a gap between said piston means and said cylinder means placing said pump working volume in flow communication with said cylinder means; said auxiliary valve means being connected to effect application of said closure pressure to said piston means within said cylinder means against the force of said spring means.

5. A vacuum pump assembly comprising: a vacuum pump including a suction port adapted to be placed in flow communication with a space to be evacuated; valve means for opening and closing said suction port; spring means biasing said valve means toward a position to open said suction port; and control means for applying to said valve means a closure pressure acting against said spring means to cause said valve means to close said suction port when said vacuum pump is stopped and for removing said closure pressure therefrom when said vacuum pump is started in order to permit opening of said suction port; said control means including auxiliary valve means operating to open and close in response to starting and stopping of said vacuum pump to control application of said closure pressure to said valve means, cylinder means, piston means operatively engaged within said cylinder means, connecting means joining said piston means with said valve means for effecting correlative movement therebetween, means enclosing a pump working volume within which said vlave means and suction port are located, and passage means placing said pump working volume in flow communication with said cylinder means; said auxiliary valve means being connected to effect application of said closure pressure to said piston means within said cylinder means against the force of said spring means; said passage means being sized to permit the suction effect of said vacuum pump to be applied in said cylinder means through said pump working volume when said auxiliary valve means is actuated to terminate application of said closure pressure and before said suction port is opened by said valve means, said passage means thereby operating to delay termination of the application of said closure pressure until after said pump working volume has been evacuated by operation of said pump.

6. A vacuum pump assembly comprising: a vacuum pump including a suction port adapted to be placed in flow communication with a space to be evacuated and an exhaust outlet; valve means for opening and closing said suction port; spring means biasing said valve means toward a position to open said suction port; and control means for applying to said valve means a closure pressure acting against said spring means to cause said valve means to close said suction port when said vacuum pump is stopped and for removing said closure pressure therefrom when said vacuum pump is started in order to permit opening of said suction port; said control means including auxiliary valve means operating to open and close in response to starting and stopping of said vacuum pump to control application of said closure pressure to said valve means, cylinder means, piston means operatively engaged within said cylinder means, connecting means joining said piston means with said valve means for effecting correlative movement therebetween, means enclosing a pump working volume within which said valve means and suction port are located, and passage means placing said pump working volume in flow communication with said cylinder means; said auxiliary valve means being connected to effect application of said closure pressure to said piston means within said cylinder means against the force of said spring means; said control means being structured with said spring means acting against one side of said piston means and with said closure pressure applied against the opposite side thereof, said auxiliary valve means being connected to apply the pressure from said exhaust outlet against said opposite side of said piston means as said closure pressure.

* * * * *